United States Patent [19]

Butler et al.

[11] 4,298,337

[45] Nov. 3, 1981

[54] FUEL BURNER HAVING FLAME STABILIZATION BY INTERNAL RECIRCULATION

[75] Inventors: G. Theodore Butler, Orlando; Travis G. Porter, Winter Garden; Harold E. Fisher, Altamonte Springs, all of Fla.

[73] Assignee: Mechtron International Corporation, Orlando, Fla.

[21] Appl. No.: 32,135

[22] Filed: Apr. 23, 1979

[51] Int. Cl.[3] ..... F23Q 9/00

[52] U.S. Cl. ..... 431/285; 431/351; 431/265; 239/406

[58] Field of Search ..... 431/265, 351, 183, 284, 431/285, 174, 175, 352; 239/405, 406

[56] References Cited

U.S. PATENT DOCUMENTS

| | | | |
|---|---|---|---|
| 1,069,243 | 8/1913 | Fogler | 239/405 |
| 2,111,908 | 3/1938 | Andrews | 431/183 |
| 2,473,347 | 6/1949 | Sanborn | 431/265 |
| 3,227,202 | 1/1966 | Morgan | 431/285 |
| 3,349,826 | 10/1967 | Poole et al. | 431/183 |
| 4,003,693 | 1/1977 | Straitz | 431/351 |

*Primary Examiner*—Carroll B. Dority, Jr.
*Attorney, Agent, or Firm*—William M. Hobby, III

[57] ABSTRACT

A fuel burner for burning liquid and gas fuels having a short combustion volume stabilized by internal circulation of the hot combustion gases and air. A turbo blower supplies a portion of the combustion air to the combustion volume via a swirl plate which produces a rotational motion of the air and fuel. The rotational motion results in a region of less-than-atmospheric pressure in the center portion of the combustion volume which causes recirculation of gases back toward the burner and a stabilization zone near the burner nozzle. Aspiration of external air into the combustion volume is controlled by a short stabilization cone and the resulting combustion volume is small, eliminating the necessity for refractory lined ignition ports and combustion chambers. Due to its very short physical length, and controlled combustion volume which has a low peak flame temperature, the fuel burner is especially suitable for transportable aggregate dryers and the like, and produces a higher capacity for such dryers for a given heat output.

6 Claims, 4 Drawing Figures

FUEL BURNER HAVING FLAME STABILIZATION BY INTERNAL RECIRCULATION

BACKGROUND OF THE INVENTION

1. Field of the Invention

The present invention relates to fuel burners and more particularly to very high capacity fuel burners using liquid fuels or gas utilized for drying and similar processes.

2. Description of the Prior Art

Large, high capacity fuel burners are generally used in industries requiring drying of various materials. For example, such burners are required for operating large rotary aggregate dryers, and for kiln drying and processing of lime, sand, bauxite, coal, cement and the like. In the making of asphalt roads, portable drying units are used for drying the aggregate before mixing with the asphalt.

In drying aggregate, as an example of an application of the fuel burners under consideration, a typical unit may have a rotating horizontal drum 50 feet in length and 8 feet in diameter. The wet rock is introduced into one end of the drum, carried to the top of the drum and dropped back. The material is gradually carried to the opposite end of the drum and removed by a conveyor. A fuel burner, which may have an outlet chamber of from one to two feet in diameter, is placed at one end of the drum. The hot gases and air emanating from the burner are directed through the falling aggregate, known as the aggregate curtain, and serves to drive out all moisture from the material. An exhaust fan at the output end of the drum draws the heated air therethrough. The gas temperature at the burner input end may be on the order of 2400° F. dropping to about 350° F. at the opposite end of the drum. For large dryers, such as described above, the burners are required to produce as much as 200 million BTU per hour.

Several typical problems in prior art burners of this nature involve the control of the combustion air, optimum atomization of oil when used as a fuel, stabilization of the flame, and obtaining large turn-down ratios. To solve some of these problems, it is common in the art to use a refractory lined combustion chamber and ignition port in combination with the burner. In this type of construction, a refractory lined quarl of frusto-conical shape is disposed with its small end at the atomizer. Known as an ignition port, the quarl produces a flame front plane transverse to the axis of the cone which serves to ignite the atomized fuel from the atomizer nozzle. The burner gases and heated air move toward the outlet end of the cone with their velocity decreasing as the cross-sectional area increases. The flame front therefore stabilizes at the transverse plane of the cone at which the flame propagation speed is essentially equal to the gas and air velocity. As the amount of fuel and air is changed with desired changes in burner output, the flame stabilization plane will therefore move forward along the cone for increased output and back toward the atomizer for reduced output. For maximum output, the flame occurs near the largest cross section of the cone, producing a very large combustion volume with flames extending forward for a considerable distance beyond the ignition port. Thus, a refractory lined combustion chamber is necessary to contain this broad combustion volume. A typical burner with a capacity of 100 million BTU per hour may require an ignition port with a length of about three feet and a combustion chamber of about four feet in diameter and five feet in length. Thus, this method of flame stabilization adds greatly to the overall burner length.

Other burners utilize a bluff body for stabilization of the flame wherein air is caused to spill over the edge of a flat plate, creating a turbulence to produce an external recirculation of hot gases which tend to stabilize the flame. However, there are limits to the range of burner output over which this method is usable. For example, when the flame output is increased, the stabilization conditions are no longer in existence and the flame tends to move outward from the burner with a possible loss of ignition. Thus, this type of burner must be operated over a relatively narrow range and any short term cessation of operation requires shut off of the burner. Energy must be utilized and operation time wasted in re-heating the refractory and the like when the burner is to be restarted.

While the use of refractory lined combustion chambers and ignition ports are effective to some extent for control of combustion, this method has several serious disadvantages. For example, the refractory material gradually spalls with use and must be periodically replaced, requiring shut down of operation and causing high maintenance costs. The refractory lined chambers also greatly increase the size of the burner system which adds to the cost of portable drying systems mounted on trailers such as used in asphalt highway construction. The length of the chambers reduces the dryer barrel length that can be used on a given trailer bed size, thereby limiting the capacity of the dryer.

Some prior art burner designs for use with oil provide means for atomization of the oil in which compressed air and oil are mixed in the atomizer. When operating at low output, both air and oil pressures are reduced. Large turn-down ratios are difficult to obtain in such burners due to the necessity of designing the nozzle for optimum atomization at maximum output. When both the oil pressure and atomizing air pressure are reduced to obtain less output, the nozzle becomes less efficient and the turn-down ratio is limited by loss of good atomization of the fuel.

Thus, a need exists for a high capacity burner which has efficient atomization, which can provide a large turn-down ratio to permit idling of the burner without excessive fuel consumption, and which will have a small combustion volume not requiring a refractory lined ignition port and combustion chamber.

SUMMARY OF THE INVENTION

The present invention is a novel, high capacity liquid fuel and gas burner which has significant advantages over known prior art burners. The burner utilizes a turbo blower for supplying a significant percentage of the combustion air. The air from the blower is directed toward the combustion area via a cylindrical casing. At the outer end of the casing, a burner cone having an inverted generally frusto-conical shape is disposed. Concentric with the burner cone is a twin fluid atomizer, and concentric with and surrounding the atomizer is a swirl plate type diffuser assembly. The twin fluid atomizer is supplied with oil via an inlet line and with compressed air via a second inlet line. The atomizer has a conical face approximately 70° from the longitudinal axis. A series of jets is provided around the periphery of the atomizer face. The compressed air and oil are mixed in each jet and the resulting oil-air mixture sprayed from the jets. The air from the turbo blower passes through the swirl plate blades and is given a high velocity of rotation. As this rotating air mixes with the sprayed fuel-air mixture from the atomizer, very thorough atomization of the oil occurs. Approximately one-third of the air required for combustion is thus provided by the combination of compressed air to the atomizer and blower air through and around the swirl plate. A second cone of frusto-conical shape is disposed just outboard from the burner cone and inverted with respect thereto. That is, the small end of the cone is towards the burner cone, flaring outward therefrom. This cone operates as a flame stabilization cone and is short relative to its diameter. For example, a stabilization cone having a maximum diameter of two feet may be on the order of eight inches in length.

The requirement for flame stabilization stems from a tendency for the forced air to carry the oil and air mixtures, or gas and air mixtures, outward away from the burner. When the velocity of such materials is greater than that of the flame propagation speed, the flame can move outward with the mixture and away from the burner. This results either in loss of ignition, or in a pulsating or throbbing combustion. In some prior art burners, large volume refractory lined ignition ports and combustion chambers have been used to stabilize the flame. These operate by virtue of a conical quarl which allows the ignition flame front to expand and contract in area by moving fore and aft in the quarl as the heat output is varied. This technique requires large, expensive refractory lined chambers and is limited in the range of outputs for which it is effective.

Advantageously, in the present invention a stabilization of the flame is produced by an internal recirculation technique resulting in a small combustion volume. Thus, the large combustion chamber and ignition port with refractory linings are not required which represents a major advantage of the invention. In operation, the swirling air created by the swirl plate produces a variation in pressure across the transverse plane of the burner. For example, at the center of the burner, there is essentially a vacuum produced with higher pressures found toward the outside of the swirling air. Thus, this vacuum or low pressure created along the center line of the burner results in recirculation of burned gases from the flame front back toward the atomizer. This flow meets the flow coming outward and at the point of intersection a zone of essentially zero pressure is found. It is at this area that the flame stabilizes. The area of stabilization has been found to be approximately 6 inches from the atomizer in a typical implementation of the invention rather than two to three feet as common in ignition port design burners.

The purpose of the stabilizer cone is to prevent dimunition of the vacuum from external air needed for combustion which will be drawn through the space between the burner cone and the flame stabilization cone into the flame area and which could reduce the center vacuum. Thus, a small annular gap is provided between the burner cone and the stabilization cone to permit the needed combustion air into the flame region with a selected area to control the amount of air such that the stabilization of the flame is not disturbed. In practice, about one-third of the combustion air enters through this annular gap. The remainder of the combustion air required enters the flame volume from around the outer periphery of the stabilization cone.

Elimination of the refractory chamber and ignition port provides an additional important advantage of the invention. The combustion control elements of the invention produce a lower peak flame temperature and thereby reduce the production of the nitrous oxide pollutants as compared to prior art burners.

The present invention provides a much greater turndown ratio than has been available in prior art burners of this type. This advantageous result stems from the use of a constant air pressure into the atomizer which results in a greater flow of atomizing air when the oil flow is reduced for low output operation ensuring efficient atomization. In conventional air-type atomizers, both the fuel pressure and the atomizing air pressure are commonly modulated. The turbo blower is also regulated in the present burner causing reduced combustion air flow when the output and oil pressure is reduced. By maintaining the atomizing air pressure constant and reducing the blower air flow, efficient atomization is still achieved even at low fuel pressure and a much lower heat output is therefore obtainable than with the conventional methods. The elimination of compressed air controllers and regulators reduces the burner cost. Thus, the burner in accordance with the invention utilizes three means for atomization which give superior mixing of air and oil over a wide range of operation: that is, constant pressure compressed air which atomizes the oil at low loads; variable oil pressure with changes in load causing hydraulic atomization; and variable air velocity combustion air with changing loads.

Tests with typical implementations of the invention have shown that a given aggregate dryer can produce a higher volume of output for a given amount of heat input than obtained with the combustion chamber type burner normally used. An investigation as to this unexpected increase in capacity with the burner of the present invention has indicated that the smaller volume of combustion products of the invention due to more rapid heat transfer to the aggregate, has resulted in less resistance to gas flow through the aggregate curtain. Thus, the dryer drum exhaust fan finds less resistance and operates more efficiently for the same number of pounds of mass.

In a portable type unit such as used for drying aggregate prior to mixing with asphalt in paving operations, the length of the drying drum is limited by the bed size of the trailer upon which it is to be mounted and the overall length of the burner. The extremely short length of the present burner in accordance with the invention as a result of elimination of a large combustion chamber, allows a much longer drying drum to be used, greatly increasing the capacity of portable systems. For example, a prior art burner may typically be fourteen feet from the rear of its housing to the end of the combustion chamber. A burner having the same output in accordance with the invention has a length of only six feet.

In order to burn gas such as natural gas or LP gas, a supply pipe concentric with the oil atomizer enters the scroll of the blower and terminates back of the oil atomizer assembly with a cap. Three gas delivery nozzles formed from short lengths of pipe with 90° elbows at the back ends are attached to the sides of the supply pipe and terminate with their open ends just back of the swirl plate. The three nozzles are preferably symmetrically located around the central supply pipe. When gas is being used, the gas flows from the open ends of the three gas delivery nozzles directly through the swirl plates and mixes with the forced air from the turbo blower also passing through the swirl plate. Complete mixing of the air and gas thus takes place. The flame generated outside of the swirl plate is stabilized by the same action as for the oil burner described above.

It is therefore a principal object of the invention to provide a fuel burner for dryers and the like which has no refractory combustion chamber, thereby resulting in a greatly reduced overall length.

It is another object of the invention to provide a fuel burner having no refractory material required, thereby reducing initial costs and maintenance costs.

It is still another object of the invention to provide a fuel burner having no internal moving parts in the burner assembly.

It is yet another object of the invention to provide a fuel burner having a large turn-down ratio, such that the burner may be allowed to idle for non-operative periods at low fuel inputs without requiring shut down and for preheating the plant during start up.

It is a further object of the invention to provide a fuel burner having aerodynamic flame stabilization.

It is still a further object of the invention to provide a fuel burner having aerodynamic flame stabilization which utilizes internal recirculation of hot gases.

It is yet another object of the invention to provide a fuel burner having a twin fluid atomizer using compressed air and liquid fuel in which the air pressure is maintained constant for all levels of liquid fuel flow.

It is another object of the invention to provide a fuel burner having a portion of the combustion air supplied at high pressure from a blower in which such air is given a spiral or swirling rotational movement prior to mixing with atomized fuel to produce a zone of low air pressure in the combustion volume.

It is a further object of the invention to provide a fuel burner having a frusto-conical element disposed around the flame or combustion volume to control aspiration of external air into the flame.

It is a further object of the invention to provide a fuel burner having a combustion control method that results in lower peak flame temperatures and thereby minimizes the production of nitrous oxide pollutants.

It is a further object of the invention to provide a fuel burner which produces more heat per unit of combustion volume than prior art burners.

It is another object of the invention to provide a fuel burner having a relatively small combustion volume, thereby increasing the efficiency of associated drying equipment.

It is another object of the invention to provide a high efficiency fuel burner having a short overall length thereby allowing a higher capacity dryer to be implemented in a given structural length.

These and other objects and advantages of the invention may be recognized from the following descriptions read in light of the drawings.

DETAILED DESCRIPTION OF THE PREFERRED EMBODIMENT

Figure 1:
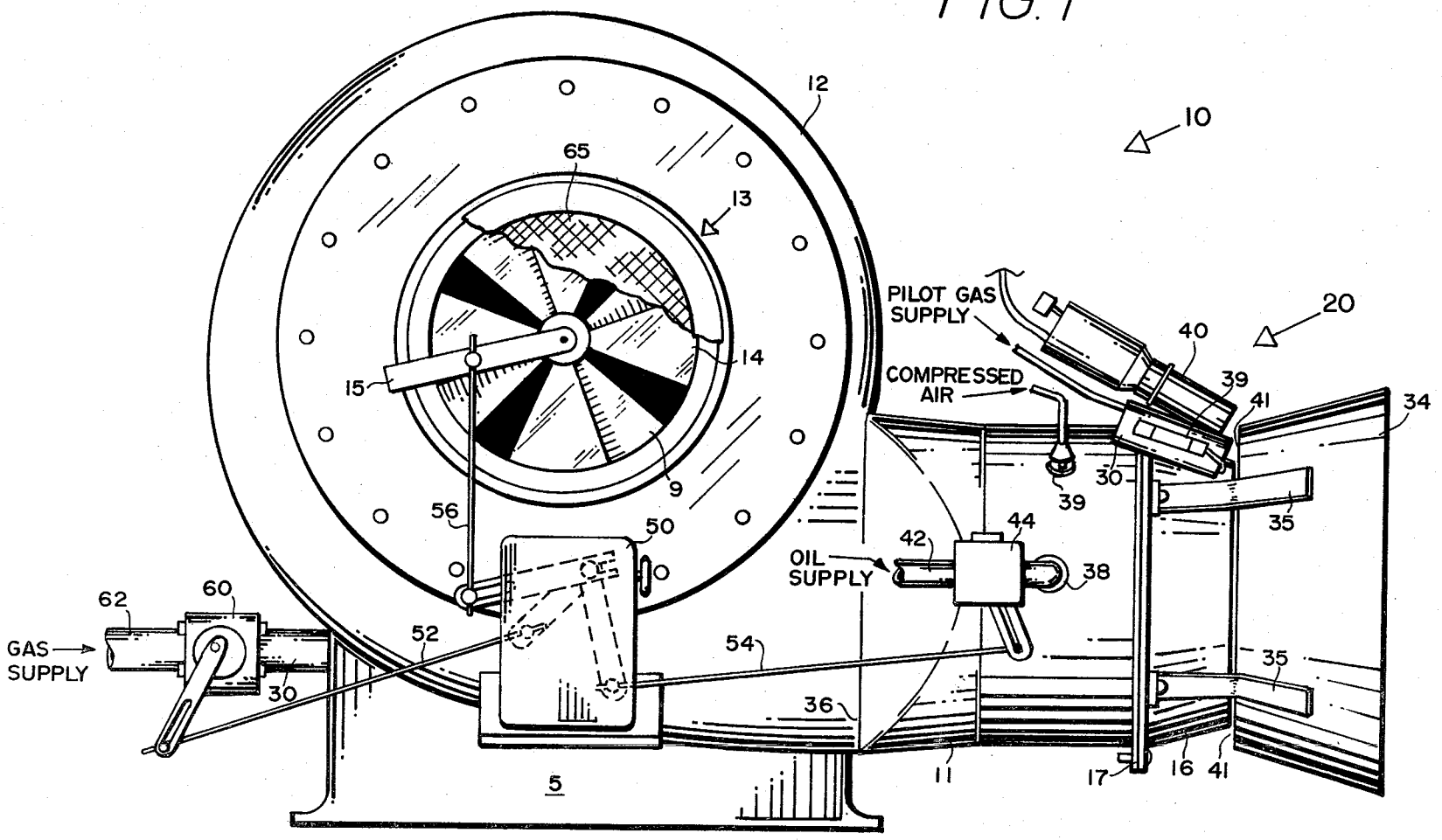
FIG. 1 is a side view of the fuel burner in accordance with the invention showing the major elements thereof.

Referring to FIG. 1, a side view of a fuel burner in accordance with the invention is shown. It is to be understood that the preferred embodiment is shown for exemplary purposes only. The fuel burner shown generally as 10 consists of several elements. First, turbo blower 12 driven by an electric motor (not shown) supplies a large volume of air under pressure at blower outlet area 36. As may best be seen in FIG. 3, blower outlet 36 may be rectangular in shape. Next, a transition section 11 serves to direct the blower air output to the combustion area. A burner cone 16 is disposed at the outlet portion of the transition section 11. Third, a flame stabilization cone 34 is provided at the outlet end of burner cone 16 and supported thereon by supports 35. Flame stabilization cone 34 serves to control the inspiration of external air into the flame area as will be discussed in more detail hereinafter. Turbo blower 12 includes an air intake assembly 13 through which external air passes into the turbo blower 12. Air intake assembly 13 contains a set of fixed radial vanes 9 and a set of rotatable air intake control vanes 14. A safety screen 65, shown cutaway, covers the entire air intake area. Rotatable air intake control vanes 14 are attached to an air intake control arm 15 which allows opening or closing of the spaces between fixed vanes 9 and control vanes 14.

The fuel burner 10 is arranged to burn either gas or a liquid fuel such as oil. The gas supply to the burner is introduced at the rear of the burner 10 through gas burner line 30. As will be shown hereinbelow gas line 30 extends into transition section 11. A gas control valve 60 connects gas burner line 30 to an input gas line 62. Oil is introduced into the burner section 20 through the wall of transition section 11 via oil inlet 38 which may be a pipe elbow. Input oil line 42 is connected to oil inlet 38 via oil control valve 44. As will be described later, compressed air is utilized in the burner atomizer and a compressed air inlet 39 is provided through the wall of transition section 11. Control 50, which may be remotely controlled, is utilized to operate the three control elements of the burner 10: oil control valve 44, gas control valve 60, and blower air intake control arm 15.

Advantageously, burner 10 can utilize a liquid fuel, such as oil or combustible liquid waste products, independently; gas, such as natural or liquified petroleum gas, independently; or the two types of fuels in combination. In either event, control motor 50 is arranged to simultaneously change the volume of air introduced into the combustion area from turbo blower 12 in a selected proportion to the amount of input fuel. The ratios of these controls may be of course varied by adjustment of oil control link 54, gas control link 52, and air control link 56 to provide the optimum ratios of control.

The fuel burner 10 is supported on a mounting base 5. A flame scanner 40 is mounted to the rear of flame stabilization cone 34 and has a view of the combustion flame area through combustion air inlet space 37. A gas pilot burner 30 may be utilized with the invention and is also mounted to the rear of stabilization cone 34.

Figure 2:
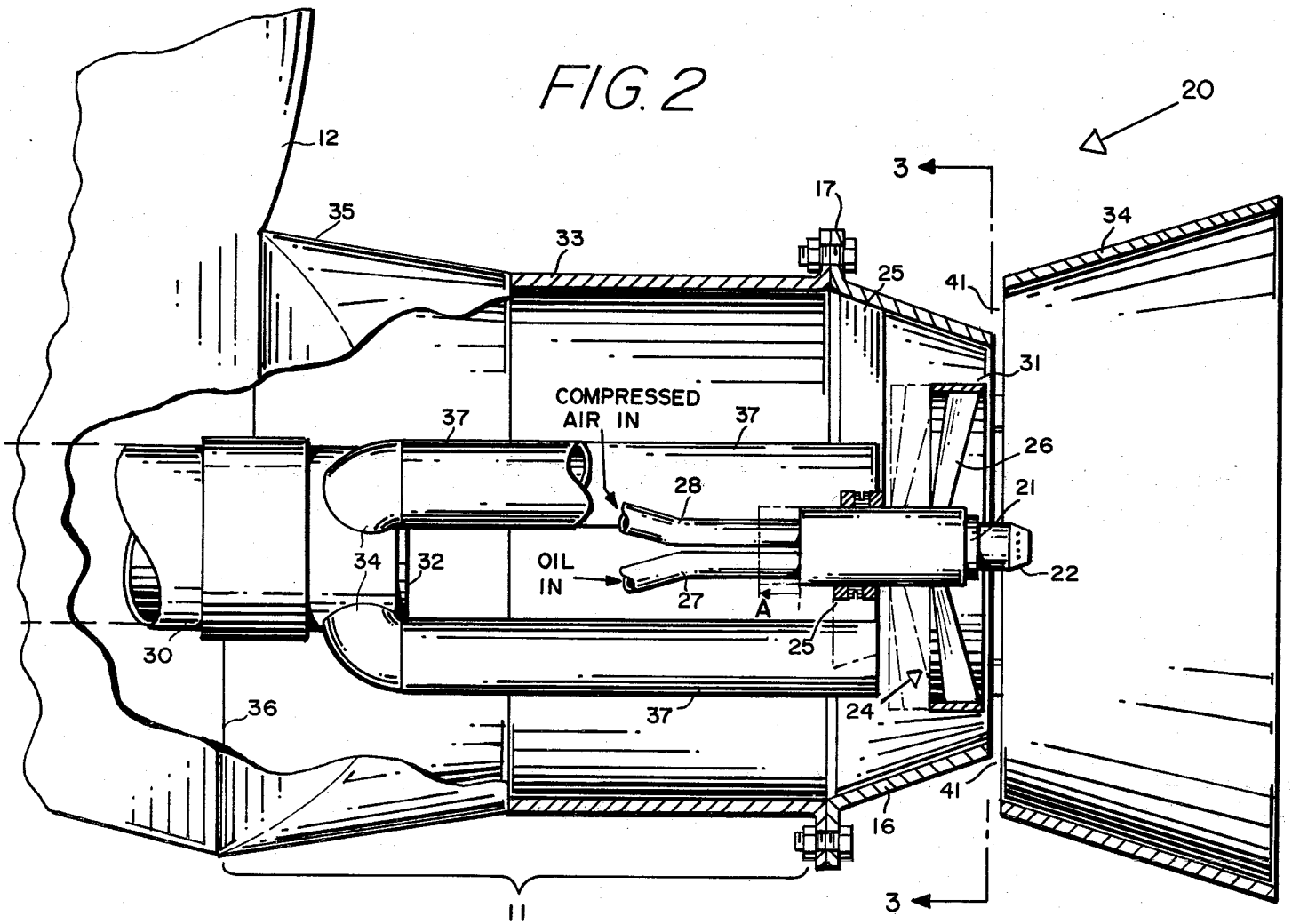
FIG. 2 is a cross sectional and partially cut away view of the burner section of the fuel burner of FIG. 1.
Figure 3:
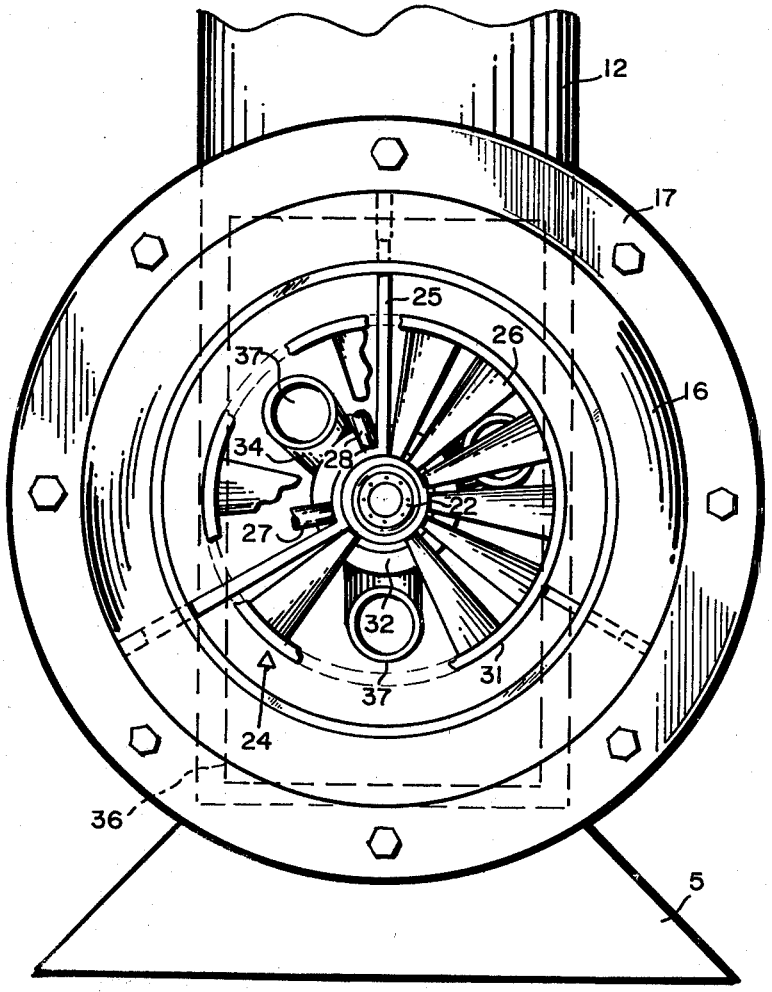
FIG. 3 is a front view of the burner section of FIG. 2 partially cut away to reveal various elements thereof.

Turning now to FIGS. 2 and 3, cross sectional and partially cutaway views of the burner section 20 of fuel burner 10 are shown. As may be noted, transition section 11 consists of a cylindrical section 33 connected on one end to burner cone 16 and on the other end to a tapering section 35 which provides a transition from the rectangular blower outlet area 36 to the cylindrical section 33. The large end of burner cone 16 is attached to cylindrical section 33 by flange 17. A spider assembly 25 is mounted within burner cone 16 to support twin fluid atomizer assembly 21. Atomizer 21 consists of a nozzle 22 having a frusto-conical face area with a series of nozzle holes around the face. Nozzle 22 is supplied liquid fuel by inlet line 27 and a compressed gas such as air via line 28. The oil and compressed air are mixed internally as they enter the atomizer nozzle 22 and the flow of oil is controlled by the oil supply pressure via oil control valve 44. The pressure entering the atomizer 21 via air line 28 is advantageously maintained at a constant pressure as will be discussed in detail hereinafter. The combination of the compressed air and oil under pressure results in internal mixing of the air and oil to atomize or break the oil into fine droplets containing oxygen and which thereafter issue from the openings in nozzle 22.

Surrounding twin fluid atomizer 21, as best seen in FIG. 3, is swirl plate assembly 24. Swirl plate assembly 24 consists of an outer ring 31 and a series of canted blades 26 attached to the outside of atomizer assembly 21 and the inside circumference of ring 31. As the air under pressure from turbo blower 12 passes through transition section 11 and burner cone 16, the air stream passes through swirl plate blades 26. The canted blades therefore tend to sharply change the direction of air flow, causing a rotating air stream exiting from the swirl plate assembly 24. The swirling air then mixes with the atomized fuel being ejected from atomizer nozzle 22, causing very thorough mixing of the swirling air with the fluid droplets and imparting a rotating motion to the atomized fuel. Flame stabilization cone 34 which has a frusto-conical shape as shown is disposed with its smaller end spaced slightly from the outlet of burner cone 16, leaving an inlet space 41 for additional external air needed for combustion to enter the volume containing the atomized fuel.

A gas pilot burner 30 is mounted to flange 17. When ignition of the burner is desired, the oil and air supply to atomizer 21 are turned on, pilot burner 30 is ignited by electrical ignition unit 39, and the flame from burner 30 ignites the atomized fuel.

The gas burner line 30 which enters at the rear of the fuel burner 10 as shown in FIG. 1 passes through the turbo blower outlet 36 and is equipped with an end cap 32 with line 30 thereby terminating within the tapered section 35. Gas burner tubes 37 are attached to the end of gas burner line 30, as shown, by elbows 34. Preferably, three gas burner tubes 37 are used and are symmetrically located around line 30. The open ends of gas burner tubes 37 are just at the rear of swirl plate assembly 24 and gas flowing from these tubes enters directly into the swirl plate blades 26. Thus, the air under pressure from blower 12 mixes with the fuel gas as they both pass through swirl plate assembly 24. As in the instance of atomized liquid fuel, the air-gas mixture achieves a swirling or rotational motion as it issues from the swirl plate assembly 24 into the combustion area within flame stabilization cone 34.

The twin fluid atomizer 21 and the swirl plate assembly 24, which are integral, are supported by support spider 25 as previously mentioned. The assembly is movable to a certain extent fore and aft in spider 25 as indicated by arrow A. This movement allows a fine adjustment of this important element of the burner to optimize performance for a given type of fuel.

Figure 4:
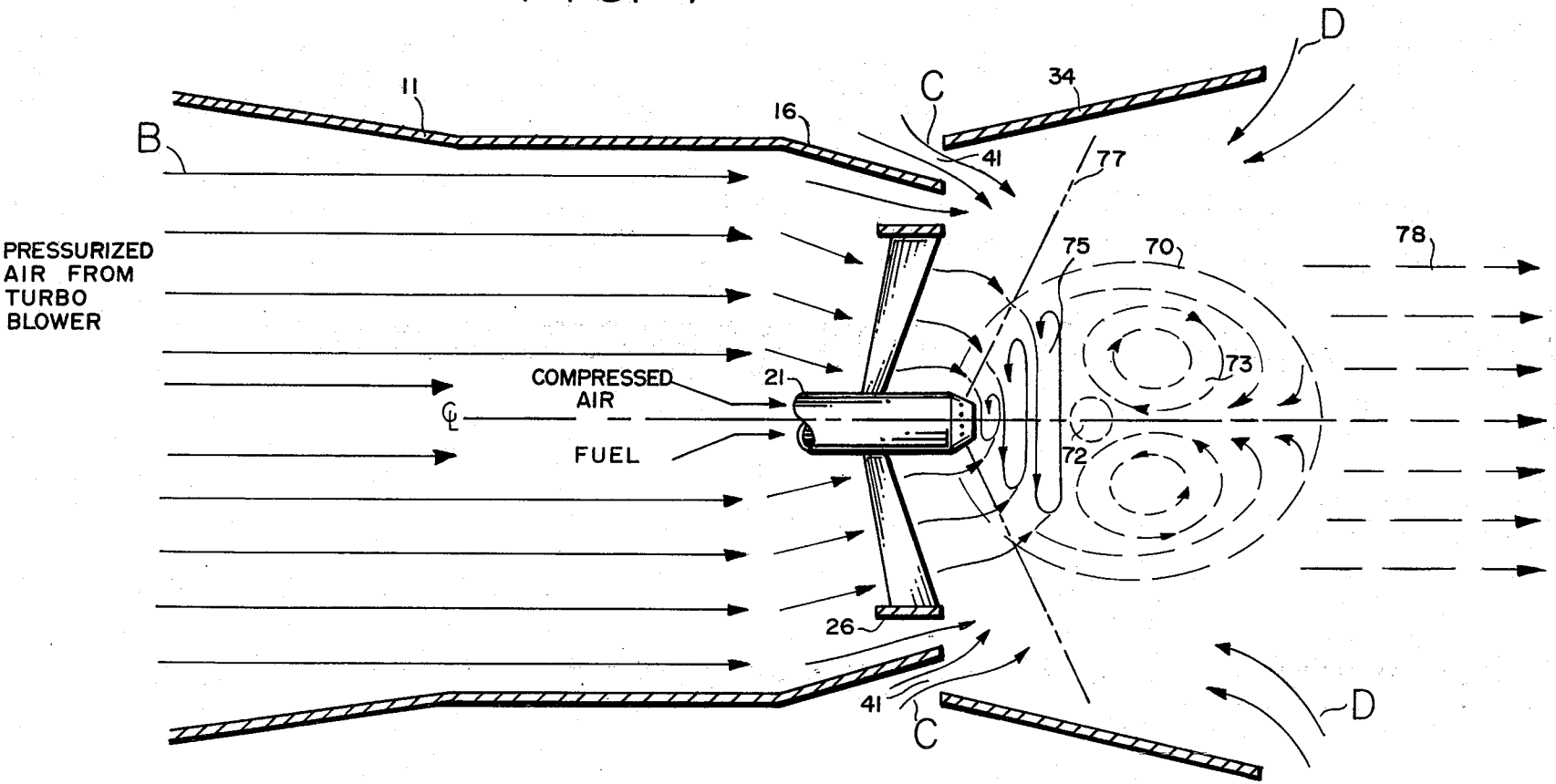
FIG. 4 is a schematic diagram of a cross section through the fuel burner illustrating the flow of air, atomized fuel and hot combustion products illustrating the manner in which the combustion volume and flame are stabilized.

Having hereinabove described in detail the physical construction of a preferred embodiment of the invention, the operation and performance of the invention will now be described. Assume that the burner is in normal operation, utilizing oil as a fuel. A volume of air indicated by B in FIG. 4 is shown entering the transition section 11 under pressure from blower 12. This air passes through swirl plate assembly 24 and is imparted a rotational or swirling motion as indicated by the flow arrows 75. Simultaneously, compressed air enters atomizer 21 along with the oil under pressure. The oil-air mixture is ejected through the nozzle area of atomizer 21 as very small oil droplets containing oxygen, entering the combustion region as indicated by the dashed flow lines 77. The swirling air 75 mixes with the atomized fuel causing it to follow the flow pattern. The rotational velocity of air 75 and consequently of the mixed atomized fuel will be a function of the distance from the center line of the burner. By applying the conservation of momentum principle, it may be seen that the velocity will be very high at the center line and will decrease with distance toward the periphery of swirl plate assembly 24. Thus, as governed by Bernoulli's theorem, the pressure will tend to be low and below atmospheric pressure near the center increasing with distance radially from the center line. As the fuel burns, the burning gases are carried outward from the atomizer 21 and the outlet end of burner cone 16. This movement is due of course to the pressure of the air from blower 12 and the expansion due to the heat generation as the mixture burns. There is a given rate of burning of fuel and a given ignition time for unburned fuel. If the outward velocity of the fuel-oil mixture is greater than the flame propagation time, (the velocity with which a flame front can move through the unburned fuel), then the source of ignition which is the previously burning fuel may be carried away from the incoming unburned fuel before the incoming fuel can ignite. This represents an unstable condition in which loss of ignition can occur. A loss of ignition may then slow the outward movement of gases allowing the unburned fuel to reignite with the process being repeated periodically. This causes an undesirable and dangerous puffing or oscillation in the combustion volume.

The burning gases, in accordance with the invention, advantageously results in a relatively small, stable combustion volume 70. Volume 70 represents an ellipsoidic envelope of burning gases having various velocity vectors such as in a longitudinal outward direction, tangential to an ellipsoid transverse cross section, and directions to cause internal circulation 73 which combine to stabilize the flame.

The present invention provides this stabilization of the combustion volume 70 so as to obtain even, non-pulsating flame conditions. As may be noted in FIG. 4, some of the hot gases and burning fuel recirculate back into the combustion volume rather than continuing away from the burner forming a torus envelope as shown in cross section by dashed lines 73. This phenomenon occurs because of the low pressure area long the center line of the burner due to the rotational motion of the air and fuel and the radial velocity gradient. As these gases move back toward the burner area with a velocity $-v(d)$ they will meet other hot gases moving with a velocity +v(d). A region within the combustion volume 70 where the two velocities are approximately equal will represent the zone of flame stabilization 72.

This type of stabilization is known as internal recirculation as contrasted with prior art burners using bluff bodies which cause an external circulation of heated gases back into the combustion volume, and which is known as external recirculation stabilization. To maintain the stable combustion volume, it is also necessary to control external air needed for combustion entering the combustion volume 70 so as not to diminish the partial vacuum or low pressure zones created by the swirling movement of the air and gas mixtures described above. To this end, stabilizer cone 34 is provided. Combustion air inlet space 41 in FIG. 4 represents an annular opening between the inlet end of stabilizer cone 34 and the outlet end of burner cone 16. This area or space is carefully selected to admit sufficient combustion air C to insure the required air for the combustion process yet small enough to prevent excessive air which would diminish the low pressure zones. Some combustion air D also will enter the combustion volume around the outlet end of stabilizer cone 34, however this air will supply the remainder of the required combustion air and will not affect the low pressure zones.

In a typical burner in accordance with the invention, the length of stabilizer cone 34 may be on the order of 10 inches. The distance from the atomizer 21 of the zone of flame stabilization 72 has been found to be on the order of 6 inches for the burner when operating at full capacity. When the output is reduced as previously mentioned, the pressurized air from blower 12 is reduced. This will result in the zone of flame stabilization 72 moving back toward the atomizer 21 toward a lower cross sectional area of cone 34. Thus, the conical shape of stabilizer cone 34 provides for such variations in burner output. By limiting the combustion volume 70 through the novel stabilization technique of the present invention, the effective length of the burner is greatly reduced over a conventional burner using an ignition port and combustion chamber. For example, in place of a 10 inch stabilizer cone, the conventional burner of the same capacity would require an ignition port and combustion chamber of about 8 feet in length.

As may be noted, the combustion air is obtained from essentially three sources. First, the pressurized air from the blower 12 and the compressed air into atomizer 21 represent approximately one-third of the combustion air; second, about one-third of the combustion air enters through air inlet space 41; and the remaining air enters external to stabilizer cone 34.

When used for aggregate drying, the outlet of stabilization cone 34 can be disposed immediately adjacent the input end of the typical drying drum with concentrated high-temperature gases 78 impinging on the aggregate curtain. An exhaust fan at the far end of the drum provides additional force for drawing the hot gases through the material to be dried.

While the flame stabilization function of the present invention has been described with reference to burning of oil or other liquid fuel, it is to be understood that the use of gas as a fuel results in the same process for flame stabilization.

Turn-down ratios, that is, the ratio of heat output at maximum capacity to heat output at minimum output, of up to 15 to 1 have been achieved with the burner of the invention. This desirable feature provides significant savings to the user by eliminating necessity to shut down the burner during brief non-operational periods and to allow pre-heating of the plant during start-up procedures. With conventional low turn-down ratio burners, when actual drying is not taking place, it is necessary to shut the burner down. Thus, the air in the dryer drums, as well as the refractory material, all will cool down during the interruption. Then, when start up is desired, the burner must be re-ignited, the refractory brought up to operating temperature in order to stabilize the flame, and the drum brought up to operating temperature. Thus, the present invention provides significant savings in fuel and operating time costs by virtue of the fact that it may be operated at greatly reduced inputs during such non-operate conditions and therefore be ready to return to full capacity very quickly. The improved low output operation results from the unique control method for air and fuel. Referring to FIG. 1, when low output operation of the burner is desired, the oil flow is reduced by operation of oil control valve 44. Automatically, the air intake control vanes 14 are closed down with respect to fixed vanes 9 by control motor 50 proportional to the reduction in oil pressure. However, the compressed air to compressed air inlet 39 is maintained at a constant pressure. The compressed air orifices of nozzle 22 may be designed for optimum atomization at low capacities. At increased capacities, the compressed air is not required for good atomization. Thus, excellent atomization can be obtained over a wide range of outputs.

As may be seen, the combination of the constant air pressure atomizer, the stationary swirl plate, the burner cone and flame stabilization cone, and the control of air entering the combustion region of the burner has provided a novel fuel burner having a small, concentrated combustion volume. In addition to the advantages of the invention disclosed hereinabove, the invention has also produced unexpected benefits to the user. In experimental tests, burners in accordance with the invention have been used to replace conventional prior art burners having ignition ports and combustion chambers. The users found that the drying capacity of their driers increased. Although the exact theory of this observed increase is not fully known, investigation indicates that with the smaller, more concentrated combustion volume of the invention, faster heat transfer occurs, causing a smaller volume of combustion products to be moved through the aggregate curtain and there is thus less resistance to the flow of gases. The exhaust fan can therefore move a higher volume of heated gases, permitting an increase in aggregate input. An additional advantage has proven to be quieter operation due to control of combustion air at the turbo blower inlet rather than on discharge.

A novel high capacity liquid fuel and gas burner for use with dryers and the like has now been disclosed. The burner of the invention has been seen to have an extremely compact and short burner section. The shortening of the burner has been made possible by a novel internal recirculation method of aerodynamically stabilizing the combustion volume. This desirable function has been accomplished by utilizing a blower introducing air under pressure through air flow direction means and having means for producing rotation of the blower air disposed at the outlet of the air flow direction means. Advantageously, the rotating air stream thus created produces a zone having less than atmospheric pressure along its center line. A liquid fuel atomizer has been provided in the outlet of the air flow directing means which utilizes a constant pressure of compressed air and fuel oil under pressure introducing the atomized liquid fuel into the rotating air stream such that when burning, the flame volume is stabilized by recirculation of gas in combustion products into the low pressure zone. Means for controlling the inspiration of external air into the combustion volume has also been provided to prevent dimunition of less than atmospheric pressure zone. A novel gas supply is provided that injects gas fuel directly into the air rotation means, mixing the gas with the blower air and simultaneously imparting rotational motion to the mixture. Although a specific design has been disclosed, it will be clear to those of ordinary skill in the art that various modifications in the elements of the described implementation may be made without departing from the spirit or scope of the invention. For example, while the exemplary embodiment of the invention uses compressed air for atomizing, steam or other gases under pressure are equally applicable.

We claim:

1. A fuel burner having a controlled size combustion volume comprising:

air pressurization means for introducing combustion air under pressure into said combustion volume, said air pressurization means includes a turbo blower and air flow directing means for directing said pressurized air into said combustion volume;

means for introducing atomized liquid fuel into the combustion volume and for mixing with the combustion air to produce a flame;

aerodynamic stabilization means for producing aerodynamic stabilization of the flame within said combustion volume by reducing the velocity of combustion gases within the flame to less than the flame propagation velocity, said aerodynamic stabilization means having air rotation means disposed adjacent to said combustion volume for causing rotation of said pressurized air from said turbo blower arranged to cause said air to enter said combustion volume in a swirling motion having a less-than-atmospheric pressure zone in the central portion thereof to cause internal recirculation of combustion gases in said combustion volume to thereby reduce the velocity of said combustion gases to less than the flame propagation velocity;

size controlling means for introducing additional combustion air into said combustion volume to limit the size thereof, said size controlling means having air aspiration control means surrounding said combustion volume for controlling introduction of outside air into said combustion volume to prevent the dimunition of such less-than-atmospheric pressure zone; and at least one gas discharge tube positioned for injecting a gas fuel into said aerodynamic stabilization means whereby a gas fuel can be mixed with combustion air.

2. In a fuel burner comprising in combination: blower means for providing combustion air to said fuel burner;

air flow directing means having an inlet portion and an outlet portion, said directing means disposed to receive and air stream under pressure from said blower means at said inlet portion;

air rotation means disposed in said outlet portion of said air flow directing means for causing rotation of the air stream as such air stream issues from said outlet portion, said air rotation means adapted to create a less-than-atmospheric pressure zone within such rotating air stream;

liquid fuel atomizing means disposed in said outlet portion of said air flow directing means for introducing atomized liquid fuel into such rotating air stream; said rotating air stream mixing with the atomized fuel for producing a combustion volume, said less-than-atmospheric pressure zone causing the combustion gases to recirculate in such volume;

at least one gas discharge tube positioned for injecting a gas fuel into said air rotation means thereby obtaining mixing of combustion air with said gas fuel; and air aspiration control means disposed adjacent to said outlet portion of said air flow directing means for preventing dimunition of such less-than-atmospheric pressure zone within such rotating air stream;

whereby the combustion volume when said burner is in operation is stabilized from the internal recirculation of combustion gases in such volume.

3. The fuel burner as defined in claim 2 in which:

said blower means is a turbo blower having air control means for varying the volume of output air from said blower; and said atomizing means includes an input for constant pressure compressed air, and an input for liquid fuel and having means for controlling the flow of said liquid fuel to said atomizing means, said liquid fuel flow means coupled to said air control means.

4. The fuel burner as defined in claim 2 in which said air aspiration control means includes a frusto-conical shaped element essentially surrounding said combustion volume and producing an annular opening between said frusto-conical element and said outlet portion of said air flow directing means, said annular opening having a selected area whereby said opening serves to limit the volume of external air flowing into said combustion volume.

5. In a fuel burner having aerodynamic flame stabilization and control of the size of the combustion volume, the combination comprising:

a turbo blower;

a transition section disposed to receive an air stream under pressure from said turbo blower;

air rotation means disposed at the output of said transition section for causing rotation of said air stream as such air stream exits said transition section, said air rotation means adapted to create a less-than-atmospheric pressure zone in a central portion of said rotating air stream;

fuel injection means disposed at said output of said transition section for injecting fuel into said rotating air stream issuing from said air rotation means for producing a combustion volume, said less-than-atmospheric pressure zone causing the combustion gases to recirculate in such volume, at least one gas discharge tube positioned for injecting a gas fuel into said air rotation means thereby obtaining mixing of combustion air with said gas fuel; and air inspiration control means surrounding said combustion volume for controlling the inspiration of external air into said combustion volume for preventing dimunition of such less-than-atmospheric pressure zone;

whereby the combustion volume when said burner is in operation is stabilized from an internal re-circulation of combustion gases due to said less-than-atmospheric pressure zone in such combustion volume and maintained at a selected size by such inspiration of external air.

6. In the fuel burner as defined in claim 5 in which said fuel injection means is a twin fluid atomizer for atomizing a liquid fuel, said atomizer having an input for a liquid fuel and means for controlling the flow of liquid fuel, and an input for constant pressure compressed air.

* * * * *